US010041430B2

(12) United States Patent
Syed et al.

(10) Patent No.: US 10,041,430 B2
(45) Date of Patent: Aug. 7, 2018

(54) SYSTEM FOR ADJUSTING A FUEL INJECTOR ACTUATOR DRIVE SIGNAL DURING A FUEL INJECTION EVENT

(71) Applicant: CUMMINS INC., Columbus, IN (US)

(72) Inventors: Jalal Syed, Indianapolis, IN (US); Ulf Carlsson, Columbus, IN (US); Rodney J. Hemmerlein, Columbus, IN (US); Douglas W. Memering, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 203 days.

(21) Appl. No.: 15/022,086

(22) PCT Filed: Sep. 16, 2014

(86) PCT No.: PCT/US2014/055856
§ 371 (c)(1),
(2) Date: Mar. 15, 2016

(87) PCT Pub. No.: WO2015/039095
PCT Pub. Date: Mar. 19, 2015

(65) Prior Publication Data

US 2016/0222905 A1 Aug. 4, 2016

Related U.S. Application Data

(60) Provisional application No. 61/878,333, filed on Sep. 16, 2013.

(51) Int. Cl.
*F02D 41/26* (2006.01)
*F02D 41/20* (2006.01)
(Continued)

(52) U.S. Cl.
CPC ..... *F02D 41/263* (2013.01); *F02D 41/20* (2013.01); *F02D 41/3863* (2013.01);
(Continued)

(58) Field of Classification Search
CPC ..... F02D 41/20; F02D 2041/202; F02D 2041/2048; F02D 2041/2051; F02D 2041/2058; F02D 2200/0602
See application file for complete search history.

(56) References Cited

U.S. PATENT DOCUMENTS 6,371,077 B1 4/2002 McGee
7,467,615 B2 12/2008 Siewert
(Continued)

OTHER PUBLICATIONS

International Search Report and Written Opinion in PCT/US2014/055856 dated Dec. 22, 2014.

*Primary Examiner* — Erick Solis
*Assistant Examiner* — Anthony L Bacon
(74) *Attorney, Agent, or Firm* — Faegre Baker Daniels LLP

(57) ABSTRACT

The present disclosure provides a system for adjusting a fuel injector drive signal during a fuel injection event wherein the system comprises an engine having a fuel injector, a fuel control module configured to generate control signals corresponding to a desired fueling profile of a fuel injection event, and a fueling profile interface module that outputs drive profile signals to the fuel injector in response to the control signals to cause the fuel injector to deliver an actual fueling profile, wherein the fueling profile interface module changes the drive profile signals during the fuel injection event in response to a parameter signal indicating a characteristic of the actual fueling profile.

26 Claims, 8 Drawing Sheets

(51) Int. Cl.
*F02D 41/38* (2006.01)
*F02M 63/02* (2006.01)

(52) U.S. Cl.
CPC ..... *F02D 2041/2048* (2013.01); *F02D 2041/2051* (2013.01); *F02D 2041/2058* (2013.01); *F02D 2200/0602* (2013.01); *F02D 2200/063* (2013.01); *F02M 63/0225* (2013.01)

(56) References Cited

U.S. PATENT DOCUMENTS

| | | | | |
|---|---|---|---|---|
| 2008/0264382 | A1 | 10/2008 | Kang | |
| 2010/0095936 | A1* | 4/2010 | Schempp | F02D 41/2096 123/478 |
| 2010/0199951 | A1 | 8/2010 | Cinpinski | |
| 2011/0100333 | A1* | 5/2011 | Toyohara | F02D 41/20 123/490 |
| 2013/0019842 | A1* | 1/2013 | Shaver | F02C 9/26 123/478 |
| 2014/0261301 | A1* | 9/2014 | Leone | F02B 17/005 123/295 |

* cited by examiner

SYSTEM FOR ADJUSTING A FUEL INJECTOR ACTUATOR DRIVE SIGNAL DURING A FUEL INJECTION EVENT

PRIORITY CLAIM

This application claims priority to U.S. provisional application Ser. No. 61/878,333 filed on 16 Sep. 2013, the entire disclosure of which is hereby expressly incorporated herein by reference.

FIELD OF THE DISCLOSURE

This disclosure relates to a system for modifying a drive profile signal provided to a fuel injector actuator during a fuel injection event.

BACKGROUND OF THE DISCLOSURE

To provide fuel to a combustion chamber of an internal combustion engine, which may be described as an injection event, a fuel injector receives a drive profile signal from a controller of the engine. In some conventional engines, the characteristics of the fuel injector are analyzed at the end of the injection event for the purpose of modifying the drive profile signal characteristics for a subsequent injection event. Such characteristics may include an on-time and a pulse amplitude.

SUMMARY OF THE DISCLOSURE

In one embodiment of the present disclosure a system is provided comprising an engine having a fuel injector, a fuel control module configured to generate control signals corresponding to a desired fueling profile of a fuel injection event, and a fueling profile interface module that outputs drive profile signals to the fuel injector in response to the control signals to cause the fuel injector to deliver an actual fueling profile, wherein the fueling profile interface module changes the drive profile signals during the fuel injection event in response to a parameter signal indicating a characteristic of the actual fueling profile. In one aspect of this embodiment the parameter signal corresponds to at least one of an analog fuel injector line pressure and an analog fuel injector actuator position. In a variant of this aspect the parameter signal is proportional to the movement of at least one of a fuel injector actuator, a fuel injector needle, a fuel injector nozzle valve element, and a fuel injector component configured to operate in response to the drive profile signals outputted by the fueling profile interface module. In another aspect of this embodiment the characteristic indicated by the parameter signal is at least one of a cylinder pressure, a fuel accumulator pressure, an engine crank angle, and a fuel pressure in an engine fuel system. In yet another aspect of this embodiment the fueling profile interface module includes a first driver device configured to generate a first set of output signals in response to a plurality of digital input signals generated from at least one of the fuel control module and an analog to digital converter. In a variant of this aspect the analog to digital converter is configured to receive a plurality of signals corresponding to characteristics of the actual fueling profile. In a variant of this variant a second driver device is included, wherein the second driver device is configured to amplify the first set of output signals and generate the drive profile signals to cause a change in the actual fueling profile. In a variant of this variant the second driver device is configured to generate one or more feedback signals corresponding to at least one of a fuel injector drive voltage and a fuel injector drive current.

In another embodiment of the present disclosure a control system is provided comprising a fuel control module configured to generate control signals corresponding to a desired fueling profile of a fuel injection event, and a fueling profile interface module including a first driver device, a second driver device, and at least one analog to digital converter, wherein the first driver device receives the control signals from the fuel control module and feedback signals from the at least one analog to digital converter and provides drive profile signals to the second driver device, the first driver device including logic configured to modify the drive profile signals during a fuel injection event in response to at least one of a fuel injection rate deviating from a predetermined threshold fuel injection rate and a fuel injection amount deviating from a predetermined threshold fuel injection amount.

In one aspect of this embodiment the desired fueling profile includes a predetermined threshold amount of fuel to be injected by a fuel injector and the drive profile signals provided by the first driver device include a predetermined threshold fuel injection rate. In another aspect of this embodiment modifying the drive profile signals includes reducing an error between the fuel injection rate and the predetermined threshold fuel injection rate and reducing an error between the fuel injection amount and the predetermined threshold fuel injection amount. In yet another aspect of this embodiment the feedback signals correspond to an internal parameter of a fuel injector and include at least one of a fuel injector line pressure and a fuel injector actuator position. In yet another aspect of this embodiment the feedback signal corresponds to at least one of an engine cylinder pressure, a fuel accumulator pressure, an engine crank angle, a fuel pressure in an engine fuel system, a fuel injector drive voltage and a fuel injector drive current. In yet another aspect of this embodiment the first driver device provides a first set of modified drive profile signals to the second driver device and the second driver device provides a second set of modified drive profile signals to a fuel injector, wherein the amplitude of the second set of modified drive profile signals is greater than the amplitude of the first set of modified drive profile signals.

In yet another embodiment of the present disclosure an apparatus is provided comprising a first input component configured to receive a plurality of control signals from a fuel control module, the plurality of control signals corresponding to one or more expected characteristics of a fuel injection event, a second input component configured to receive one or more feedback signals corresponding to one or more actual characteristics of the fuel injection event, and a plurality of logic cells configured to provide a modified fuel injector drive signal during the fuel injection event based on the plurality of control signals and the one or more feedback signals. In one aspect of this embodiment the one or more feedback signals correspond to at least one of an engine fuel rail pressure, a fuel injector actuator voltage, a fuel injector actuator current, an engine cylinder pressure, and a fuel injector line pressure. In another aspect of this embodiment the plurality of control signals provided by the fuel control module correspond to at least one of an expected fuel injector line pressure, an expected engine cylinder pressure, an expected fuel injector actuator voltage, an expected fuel injector actuator current, an expected engine fuel rail pressure, and a fuel injector correction trim. In yet another aspect of this embodiment the plurality of logic cells are configured to include signal summing modules that receive the one or more feedback signals and the plurality of control signals, and to provide at least one of a fuel injector line pressure deviation signal, an engine cylinder pressure deviation signal, a fuel injector actuator voltage deviation signal, and a fuel injector actuator current deviation signal.

In yet another aspect of this embodiment the plurality of logic cells are configured to include an engine fuel rail pressure adjustment module that provides an engine fuel rail pressure scaling factor signal based on the expected engine fuel rail pressure signal and the engine fuel rail pressure feedback signal. In yet another aspect of this embodiment the plurality of logic cells are configured to include a fuel injector line pressure adjustment module that provides a fuel injector line pressure control signal based on the fuel injector line pressure deviation signal, an engine cylinder pressure adjustment module that provides an engine cylinder pressure control signal based on the engine cylinder pressure deviation signal, and a fuel injector actuator voltage or current adjustment module that provides at least one of a fuel injector actuator voltage control signal based on the fuel injector actuator voltage deviation signal and a fuel injector actuator current control signal based on the fuel injector actuator current deviation signal. In yet another aspect of this embodiment the signal summing modules are configured to modify the fuel injector drive signal by at least of the fuel rail pressure scaling factor signal, the fuel injector line pressure control signal, the engine cylinder pressure control signal, the fuel injector actuator voltage control signal, and the fuel injector actuator current control signal.

In yet another embodiment of the present disclosure a method is provided comprising providing a drive profile signal to a fuel injector to cause a fuel injection event, receiving a feedback signal indicating a parameter value of the fuel injection event, determining a deviation value by comparing the parameter value to an expected value of the fuel injection event, and modifying the drive profile signal during the fuel injection event in response to the deviation value exceeding a predetermined threshold deviation value. In one aspect of this embodiment the feedback signal indicating a parameter value corresponds to at least one of a fuel injector line pressure, a fuel injector actuator position, an engine cylinder pressure, an engine fuel rail pressure, an engine crank angle, a fuel accumulator pressure, a fuel injector actuator voltage, and a fuel injector actuator current. In a variant of this aspect the expected value includes at least one of an expected fuel injector line pressure, an expected fuel injector actuator position, an expected engine cylinder pressure, an expected engine fuel rail pressure, an expected engine crank angle, an expected fuel accumulator pressure, an expected fuel injector actuator voltage, and an expected fuel injector actuator current. In another aspect of this embodiment the drive profile signal includes a parameter value corresponding to an expected threshold fuel injection rate and an expected threshold fuel injection amount. In yet another aspect of this embodiment modifying the fuel injector drive signal includes reducing an error between a fuel injection rate and the expected threshold fuel injection rate and reducing an error between a fuel injection amount and the expected threshold fuel injection amount.

DETAILED DESCRIPTION OF EMBODIMENTS

Figure 1:
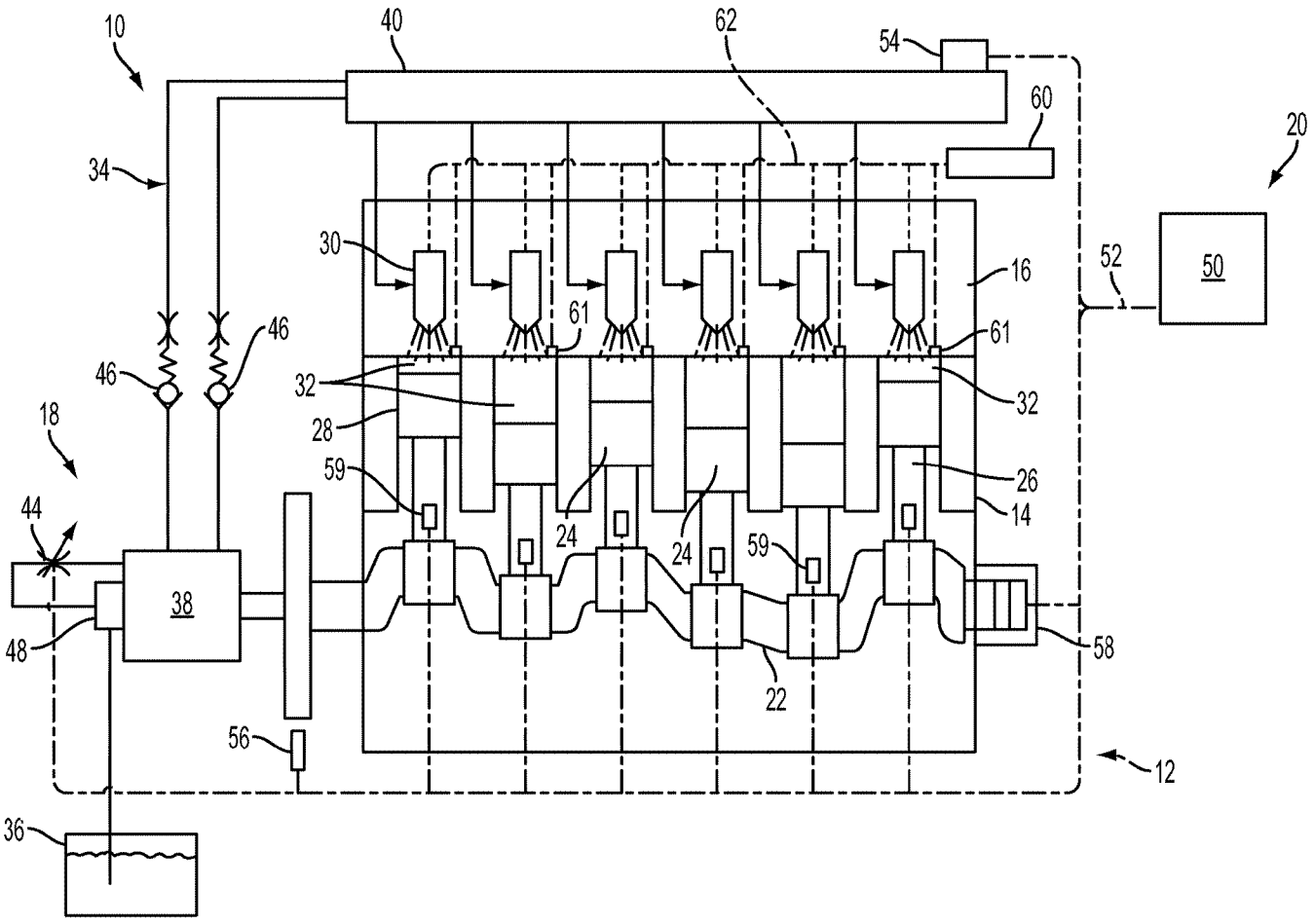
FIG. 1 is a schematic of an internal combustion engine incorporating an exemplary embodiment of the present disclosure.

Features of the embodiments of this disclosure will become more apparent from the following detailed description of exemplary embodiments when viewed in conjunction with the accompanying drawings.

In certain embodiments, engine 10 described below includes a control system structured to perform certain operations to control a fuel subsystem of an internal combustion engine. In certain embodiments, the controller forms a portion of a processing subsystem including one or more computing devices having memory, processing, and communication hardware. The controller may be a single device or a distributed device, and the functions of the controller may be performed by hardware and/or as computer instructions on a non-transient computer readable storage medium.

In certain embodiments, the controller includes one or more modules structured to functionally execute the operations of the controller. In certain embodiments, the controller may include a combustion definition module, a fueling target module, and/or a fueling control module. An example controller may additionally or alternatively include a cylinder oxygen determination module. The description herein including modules emphasizes the structural independence of certain aspects of the controller, and illustrates one grouping of operations and responsibilities of the controller. Other groupings that execute similar overall operations are understood within the scope of the present application. Modules may be implemented in hardware and/or as computer instructions on a non-transient computer readable storage medium, and modules may be distributed across various hardware or computer based components. More specific descriptions of certain embodiments of controller operations are included in the below paragraphs of the present disclosure.

Example and non-limiting module implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

One of skill in the art, having the benefit of the disclosures herein, will recognize that in certain embodiments of the present disclosure a controller may be structured to perform operations that improve various technologies and provide improvements in various technological fields. Without limitation, example and non-limiting technology improvements include improvements in combustion performance of internal combustion engines, improvements in emissions performance, aftertreatment system regeneration, engine torque generation and torque control, engine fuel economy performance, improved durability of exhaust system components for internal combustion engines, and engine noise and vibration control. Without limitation, example and non-limiting technological fields that are improved include the technological fields of internal combustion engines, fuel systems therefore, aftertreatment systems therefore, air handling devices therefore, and intake and exhaust devices therefore.

Certain operations described herein include operations to interpret and/or to determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Referring to FIG. 1, a portion of an internal combustion engine in accordance with an exemplary embodiment of the present disclosure is shown as a simplified schematic and generally indicated at 10. Engine 10 includes an engine body 12, which includes an engine block 14 and a cylinder head 16 attached to engine block 14, a fuel system 18, and a control system 20. Control system 20 receives signals from sensors located on engine 10 and transmits control signals to devices located on engine 10 to control the function of those devices, such as one or more fuel injectors. While engine 10 works well for its intended purpose, one challenge is optimizing the efficiency of combustion in engine 10. Various techniques have been proposed to improve the efficiency of combustion, such as rate shaping. In conventional rate shaping techniques, if the fuel system has the capability of analyzing fueling characteristics, then that analysis is fed forward to adjust the rate shaping characteristics of a subsequent fuel injection event. The present disclosure provides an improved system of adjusting a fuel injector actuator drive profile signal during a fuel injection event, in comparison to conventional rate shaping techniques that include the ability to adjust a fuel injector actuator drive profile signal, but do so only for future fuel injection events as opposed to a fuel injection event in progress. By adjusting the fuel injector actuator drive profile signal, including the shape of the drive profile signal, the amplitude of the drive profile signal, and the length of the drive profile signal, fueling for each injection event may be improved and optimized during an injection event. Examples of the types of actuators that may be used are a piezoelectric or a magnetostrictive actuator. However, any fuel injector actuator that responds in proportion to the amplitude of the voltage and current of the drive profile signal may be used.

Examples of rate-shaping systems and methods are described in U.S. Pat. Nos. 5,619,969, 5,983,863, 6,199,533, and 7,334,741, the entire contents of which are hereby incorporated by reference in their entirety. Another technique for rate-shaping is to provide a constant fuel flow rate while varying fuel flow pressure. Further details regarding the use and implementation of a fuel injector having the capability of providing a constant fuel flow rate with a variable pressure in the fuel injector is set forth in detail in a co-pending U.S. application Ser. No. 13/915,305, filed on Jun. 13, 2013, the entire content of which is hereby incorporated by reference.

Engine body 12 includes a crank shaft 22, a plurality of pistons 24, and a plurality of connecting rods 26. Pistons 24 are positioned for reciprocal movement in a plurality of engine cylinders 28, with one piston positioned in each engine cylinder 28. One connecting rod 26 connects each piston 24 to crank shaft 22. As will be seen, the movement of pistons 24 under the action of a combustion process in engine 10 causes connecting rods 26 to move crankshaft 22.

A plurality of fuel injectors 30 are positioned within cylinder head 16. Each fuel injector 30 is fluidly connected to a combustion chamber 32, each of which is formed by one piston 24, cylinder head 16, and the portion of engine cylinder 28 that extends between a respective piston 24 and cylinder head 16.

Fuel system 18 provides fuel to injectors 30, which is then injected into combustion chambers 32 by the action of fuel injectors 30, forming one or more injection events. The injection event may be defined as the interval that begins with the movement of a nozzle or needle valve element (not shown), permitting fuel to flow from fuel injector 30 into an associated combustion chamber 32, until the nozzle or needle valve element blocks the flow of fuel from fuel injector 30 into combustion chamber 32. Fuel system 18 includes a fuel circuit 34, a fuel tank 36, which contains fuel, a high-pressure fuel pump 38 positioned along fuel circuit 34 downstream from fuel tank 36, and a fuel accumulator or rail 40 positioned along fuel circuit 34 downstream from high-pressure fuel pump 38. While fuel accumulator or rail 40 is shown as a single unit or element, accumulator 40 may be distributed over a plurality of elements that transmit or receive high-pressure fuel, such as fuel injector(s) 30, high-pressure fuel pump 38, and any lines, passages, tubes, hoses and the like that connect high-pressure fuel to the plurality of elements. Fuel system 18 may further include an inlet metering valve 44 positioned along fuel circuit 34 upstream from high-pressure fuel pump 38 and one or more outlet check valves 46 positioned along fuel circuit 34 downstream from high-pressure fuel pump 38 to permit one-way fuel flow from high-pressure fuel pump 38 to fuel accumulator 40. Though not shown, additional elements may be positioned along fuel circuit 34. For example, inlet check valves may be positioned downstream from inlet metering valve 44 and upstream from high-pressure fuel pump 38, or inlet check valves may be incorporated in high-pressure fuel pump 38. Inlet metering valve 44 has the ability to vary or shut off fuel flow to high-pressure fuel pump 38, which thus shuts off fuel flow to fuel accumulator 40. Fuel circuit 34 connects fuel accumulator 40 to fuel injectors 30, which receive fuel from fuel accumulator 40 and then provide controlled amounts of fuel to combustion chambers 32. Fuel system 18 may also include a low-pressure fuel pump 48 positioned along fuel circuit 34 between fuel tank 36 and high-pressure fuel pump 38. Low-pressure fuel pump 48 increases the fuel pressure to a first pressure level prior to fuel flowing into high-pressure fuel pump 38.

Control system 20 may include a controller or control module 50, a wire harness 52, an interface module 60, and an interface module wire harness 62. Many aspects of the disclosure are described in terms of sequences of actions to be performed by elements of a computer system or other hardware capable of executing programmed instructions, for example, a general purpose computer, special purpose computer, workstation, or other programmable data processing apparatus. It will be recognized that in each of the embodiments, the various actions could be performed by specialized circuits (e.g., discrete logic gates interconnected to perform a specialized function), by program instructions (software), such as logical blocks, program modules, etc. being executed by one or more processors (e.g., one or more microprocessors, a central processing unit (CPU), and/or application specific integrated circuit), or by a combination of both. For example, embodiments can be implemented in hardware, software, firmware, middleware, microcode, or any combination thereof. The instructions can be program code or code segments that perform necessary tasks and can be stored in a non-transitory machine-readable medium such as a storage medium or other storage(s). A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents.

The non-transitory machine-readable medium can additionally be considered to be embodied within any tangible form of computer readable carrier, such as solid-state memory, magnetic disk, and optical disk containing an appropriate set of computer instructions, such as program modules, and data structures that would cause a processor to carry out the techniques described herein. A computer-readable medium may include the following: an electrical connection having one or more wires, magnetic disk storage, magnetic cassettes, magnetic tape or other magnetic storage devices, a portable computer diskette, a random access memory (RAM), a read-only memory (ROM), an erasable programmable read-only memory (e.g., EPROM, EEPROM, or Flash memory), or any other tangible medium capable of storing information.

It should be noted that the system of the present disclosure is illustrated and discussed herein as having various modules and units which perform particular functions. It should be understood that these modules and units are merely schematically illustrated based on their function for clarity purposes, and do not necessarily represent specific hardware or software. In this regard, these modules, units and other components may be hardware and/or software implemented to substantially perform their particular functions explained herein. The various functions of the different components can be combined or segregated as hardware and/or software modules in any manner, and can be useful separately or in combination. Input/output or I/O devices or user interfaces including but not limited to keyboards, displays, pointing devices, and the like can be coupled to the system either directly or through intervening I/O controllers. Thus, the various aspects of the disclosure may be embodied in many different forms, and all such forms are contemplated to be within the scope of the disclosure.

Control system 20 may also include an accumulator pressure sensor 54, a cylinder pressure sensor that measures, either directly or indirectly, cylinder pressure, and a crank angle sensor. While sensor 54 is described as being a pressure sensor, sensor 54 may be other devices that may be calibrated to provide a pressure signal that represents fuel pressure, such as a force transducer, strain gauge, or other device. The cylinder pressure sensor may be a sensor such as a strain gauge sensor 59 positioned in a location to measure the force generated in combustion chamber 32. For example, strain gauge sensor 59 may be positioned along connecting rod 26, as shown in the exemplary embodiment of FIG. 1, and thus strain gauge sensor 59 indirectly measures the pressure in combustion chamber 32. A cylinder pressure sensor 61 may be positioned to directly measure pressure in combustion chamber 32. The crank angle sensor may be a toothed wheel sensor 56, a rotary Hall sensor 58, or other type of device capable of measuring the rotational angle of crankshaft 22. Control system 20 uses signals received from accumulator pressure sensor 54 and the crank angle sensor to determine the combustion chamber receiving fuel, which is then used to analyze the signals received from accumulator pressure sensor 54.

Control module 50 may be an electronic control unit or electronic control module (ECM) that may monitor conditions of engine 10 or an associated vehicle in which engine 10 may be located. Control module 50 may be a single processor, a distributed processor, an electronic equivalent of a processor, or any combination of the aforementioned elements, as well as software, electronic storage, fixed lookup tables and the like. Control module 50 may include digital or analog circuitry. Control module 50 may connect to certain components of engine 10 by wire harness 52, though such connection may be by other means, including a wireless system. For example, control module 50 may connect to and provide control signals to inlet metering valve 44 and to interface module 60. Interface module 60 connects to fuel injectors 30 by way of interface module wire harness 62.

Figure 2:
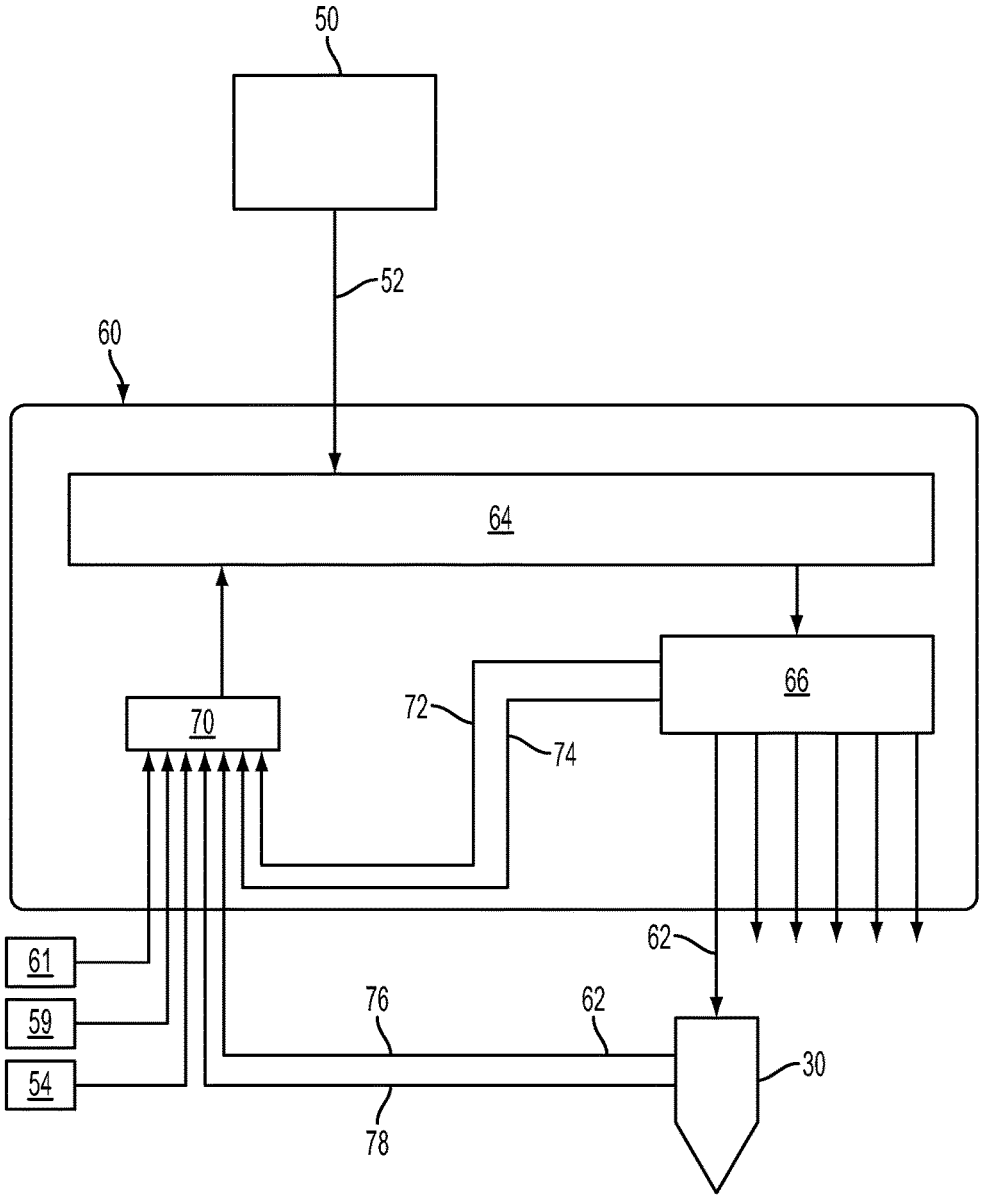
FIG. 2 is a schematic of a control system incorporating an exemplary embodiment of the present disclosure.

Referring to FIG. 2, interface module 60 includes an Application Specific Integrated Circuit (ASIC) that may be implemented as a Field Programmable Gate Array (FPGA), or ASIC/FPGA 64. ASIC/FPGA 64 is a high-speed device that accepts signals from control module 50 and from other locations, described further hereinbelow, and generates a fuel injector drive profile signal that includes various drive characteristics, including a shape of the drive profile signal, an amplitude of the drive profile signal, and a duration or pulse width of the drive profile signal. Interface module 60 further includes a fuel injector driver 66, and an Analog to Digital Converter (ADC) 70.

ASIC/FPGA 64 transmits the fuel injector drive profile signal to fuel injector driver 66, which amplifies the fuel injector drive profile signal and then transmits the drive profile signal to each of the plurality of fuel injectors 30 when commanded by control module 50. Fuel injector driver 66 transmits one or more feedback signals to ADC 70, which may include a signal indicative of the drive voltage and the drive current, which may be described as a piezoelectric, piezo, or magnetostrictive drive voltage signal 72 and a piezoelectric, piezo, or magnetostrictive drive current signal 74.

Fuel injector 30 may include a sensor connected to the interior of fuel injector 30, or to fuel circuit 34 between fuel rail or accumulator 40 and fuel injector 30, which provides an analog line pressure signal 76 as a feedback signal to ADC 70. Fuel injector 30 may also include a sensor that provides an analog actuator feedback signal 78 proportional to the actual movement of a fuel injector actuator, a needle or nozzle valve element (not shown) position, a fuel injection rate shape, or other component or feature that is configured to operate in response to the drive signal profile. Such a sensor may be, for example, a piezoelectric feedback force sensor. A signal indicative of pressure in combustion chamber 32, which may be described as a cylinder pressure signal, may be transmitted from a sensor such as strain gauge sensor 59 and/or cylinder pressure sensor 61. The analog signal transmitted by accumulator pressure sensor 54 may also be provided to ADC 70. ADC 70 receives the plurality of analog feedback signals and changes the plurality of analog feedback signals into a serial digital signal that is transmitted to ASIC/FPGA 64. Because ADC 70 may be limited in the number of inputs, or for reasons of speed, multiple analog to digital converters may be provided to receive the plurality of feedback signals associated with each fuel injector 30. Because the system of the present disclosure uses feedback signals to control the fuel injector drive profile signal, the disclosed system is considered a closed loop system. The closed loop system of the present disclosure provides significant advantage with respect to accuracy and repeatability as compared to an open loop system that infers characteristics based on an indirect measurement, such as a fuel rail or accumulator pressure. Thus the fueling tolerance or bandwidth may be significantly decreased with the present system in comparison to conventional systems.

Once ASIC/FPGA 64 receives the feedback signal(s), ASIC/FPGA 64 analyzes the actual fuel injection rate and calculates the amount of fuel being delivered by fuel injector 30 during the injection event. If the fuel injection rate deviates from the fuel injection rate expected based on the fuel injector drive profile signal established by ASIC/FPGA 64, or if the amount of fuel being delivered by fuel injector 30 is different from the amount of fuel requested by controller or control module 50, ASIC/FPGA 64 is capable of modifying the fuel injector drive profile signal to correct or adjust the fuel injector drive profile signal and/or adjust the amount of fuel delivered while the injection event is in progress. ASIC/FPGA 64 is also capable of modifying the fuel injector drive profile signal during an injection if requested by control module 50. ASIC/FPGA 64 is capable of such adjustment because ASIC/FPGA 64 is a dedicated circuit that functions only to receive various signals, to analyze them, and to modify the fuel injector drive profile signal nearly in real time, with a response time that is approximately 10 microseconds or less in comparison to a fuel injection event that extends over an interval that may be in the range of two to three milliseconds.

Figure 3:
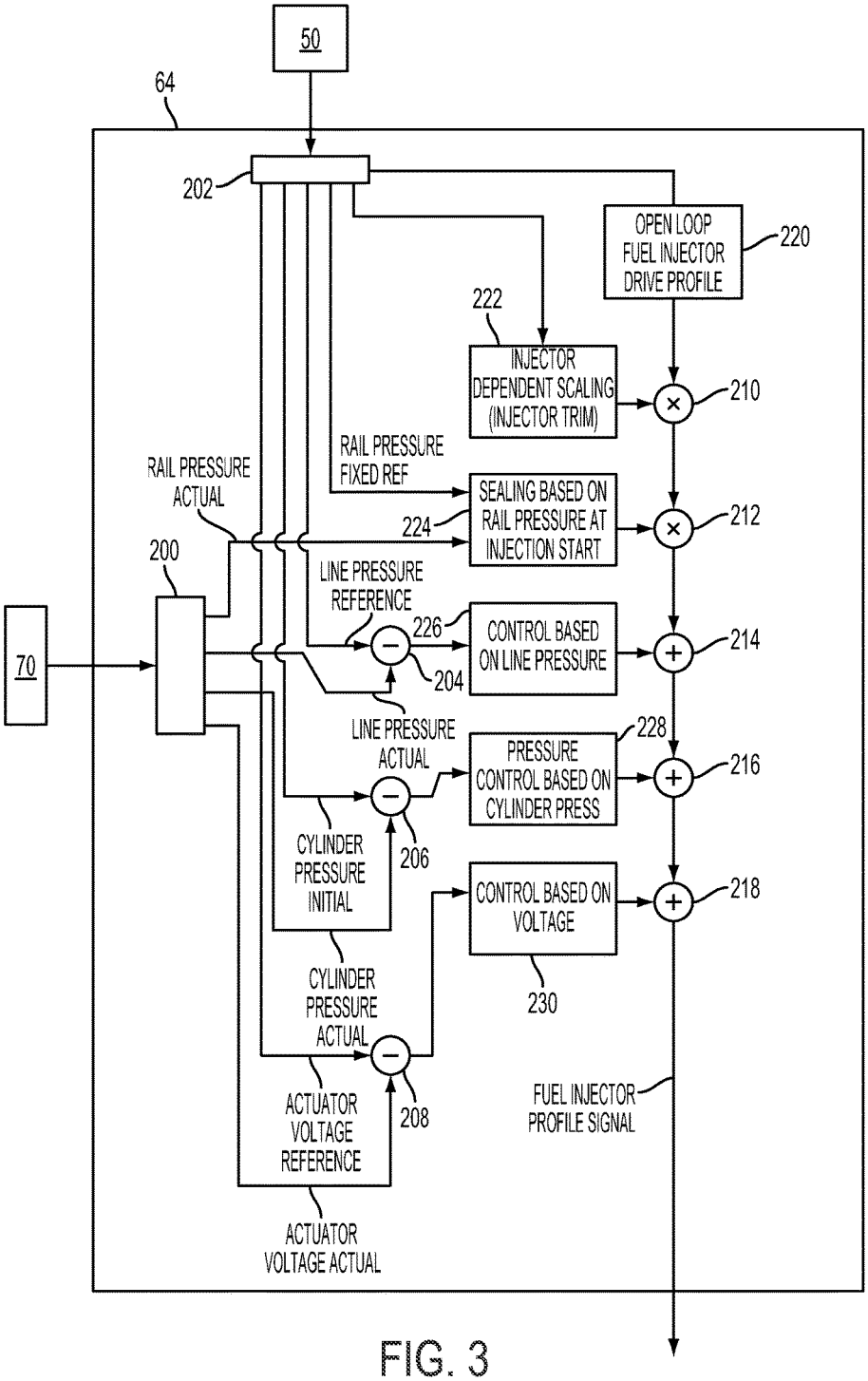
FIG. 3 is a schematic of an apparatus used in the control system of FIG. 2.

Referring to FIG. 3, ASIC/FPGA 64 includes a first serial-to-parallel converter 200, a second serial-to-parallel converter 202, a plurality of signal summing or signal operation modules, including a first signal summing module 204, a second signal summing module 206, a third signal summing module 208, a fourth signal summing module 210, a fifth signal summing module 212, a sixth signal summing module 214, a seventh signal summing module 216, an eighth signal summing module 218, a drive profile signal generator 220, an injector trim adjustment module 222, a rail pressure adjustment module 224, a line pressure adjustment module 226, a cylinder pressure adjustment module 228, and a voltage/current adjustment module 230. ASIC/FPGA 64 receives the serial digital signal from ADC 70 and a serial digital signal from control module 50. The serial digital signal from ADC 70 is converted to a plurality of parallel digital signals by first serial-to-parallel converter 200. First serial-to-parallel converter 200 provides a signal representing the actual fuel rail or accumulator 40 pressure to rail pressure adjustment module 224, a signal representing the actual line pressure in fuel injector 30 to first signal summing module 204, a signal representing the actual cylinder pressure to second signal summing module 206, and a signal representing the actual fuel injector actuator voltage is provided to the third signal summing module 208. Second serial-to-parallel converter 202 converts the serial digital signal from control module 50 into a plurality of parallel digital signals. Second serial-to-parallel converter 202 then provides a line pressure reference signal to first signal summing module 204, an initial cylinder pressure signal to second signal summing module 206, a fuel injector actuator voltage reference to third signal summing module 208, a rail pressure fixed reference to rail pressure adjustment module 224, and fuel injection characteristics to drive profile signal generator 220.

First signal summing module 204 subtracts the actual line pressure from the line reference pressure and provides the line pressure difference or deviation to line pressure adjustment module 226. Second signal summing module 206 subtracts the actual cylinder pressure from the initial cylinder pressure, which is the cylinder pressure at the beginning of the fuel injection event, and provides the cylinder pressure difference or deviation to cylinder pressure adjustment module 228. Third signal summing module 208 subtracts the actual actuator voltage from the reference actuator voltage and provides the actuator voltage difference or deviation to voltage/current adjustment module 230.

Drive profile signal generator 220 creates a fuel injector drive profile signal using the fuel injection characteristics provided by control module 50 and transmits the fuel injector drive profile signal to the fourth signal summing module 210. ASIC/FPGA 64 then uses one or more feedback signals to modify the fuel injector drive profile signal to provide improvements to the fuel injector drive profile signal, improving the accuracy of the fuel injection rate as it flows into combustion chamber 32, described in more detail hereinbelow.

Injector trim adjustment module 222 generates a correction factor signal using correction factor or trim information for each fuel injector 30 stored in control module 50 and transmitted to injector trim adjustment module 222 by control module 50. The fuel injector correction factor or trim is measured during assembly and testing of fuel injector 30 prior to assembly of fuel injector 30 into engine 10. The correction factor signal is transmitted to fourth signal summing module 210, where the fuel injector drive profile signal is multiplied by the trim or correction factor signal.

The modified fuel injector drive profile signal is then multiplied by a rail pressure scaling factor signal generated in initial rail pressure adjustment module 224 and transmitted to fifth signal summing module 212, where fuel injector drive profile signal is multiplied by the rail pressure scaling factor signal. The fuel injector drive profile signal is then adjusted by a line pressure control signal determined or calculated in line pressure adjustment module 226 based on the line pressure difference or deviation, which is provided to line pressure adjustment module 226 by first signal summing module 204. In an exemplary embodiment, line pressure adjustment module 226 may include a Proportional-Derivative (PD) control algorithm. The line pressure control signal from line pressure adjustment module 226 is transmitted to sixth summing module 214, where it is summed with the fuel injector drive profile signal.

The fuel injector drive profile signal is next adjusted by a cylinder pressure control signal determined or calculated in cylinder pressure adjustment module 228 based on the cylinder pressure difference or deviation, which is provided to cylinder pressure adjustment module 228 by second signal summing module 206. In an exemplary embodiment, cylinder pressure adjustment module 228 may include a Proportional (P) control algorithm. The cylinder pressure control signal from cylinder pressure adjustment module 228 is transmitted to seventh signal summing module 216, where it is summed with the fuel injector drive profile signal.

In the exemplary embodiment, the fuel injector drive profile signal is finally adjusted by a voltage control signal determined or calculated in voltage/current adjustment module 230 based on the actuator voltage difference or deviation, which is provided to voltage/current adjustment module 230 by third signal summing module 208. In an exemplary embodiment, voltage/current adjustment module 230 may include a Proportional-Derivative (PD) control algorithm. The voltage/current control signal from voltage/current adjustment module 230 is transmitted to eighth signal summing module 218, where it is summed with the fuel injector drive profile signal. While the connection of current feedback signal 74 is not explicitly shown in FIG. 3, voltage/current adjustment module 230 may also accept current feedback signal 74 and use current feedback signal 74 to develop the voltage/current adjustment provided to eighth summing module 218.

While in the exemplary embodiment, ASIC/FPGA 64 is described as receiving feedback from various locations on engine 10, other embodiments may receive feedback from more locations or fewer locations, depending on the availability of sensors and the accuracy of the fuel injector drive profile signal required from FGPA/ASIC 64. In the exemplary embodiment, ASIC/FPGA 64 is also described as having various types of control algorithms. The types of control algorithms used may be other than those described hereinabove, as long as the control algorithms provide the capability of identifying the characteristics of the signals described hereinabove.

When engine 10 is operating, combustion in combustion chambers 32 causes the movement of pistons 24. The movement of pistons 24 causes movement of connecting rods 26, which are drivingly connected to crankshaft 22, and movement of connecting rods 26 causes rotary movement of crankshaft 22. The angle of rotation of crankshaft 22 is measured by engine 10 to aid in timing of combustion events in engine 10 and for other purposes. The angle of rotation of crankshaft 22 may be measured in a plurality of locations, including a main crank pulley (not shown), an engine flywheel (not shown), an engine camshaft (not shown), or on the camshaft itself. Measurement of crankshaft 22 rotation angle may be made with toothed wheel sensor 56, rotary Hall sensor 58, and by other techniques. A signal representing the angle of rotation of crankshaft 22, also called the crank angle, is transmitted from toothed wheel sensor 56, rotary hall sensor 58, or other device to control system 20.

Crankshaft 22 drives high-pressure fuel pump 38 and low-pressure fuel pump 48. The action of low-pressure fuel pump 48 pulls fuel from fuel tank 36 and moves the fuel along fuel circuit 34 toward inlet metering valve 44. From inlet metering valve 44, fuel flows downstream along fuel circuit 34 through inlet check valves (not shown) to high-pressure fuel pump 38. High-pressure fuel pump 38 moves the fuel downstream along fuel circuit 34 through outlet check valves 46 toward fuel accumulator or rail 40. Inlet metering valve 44 receives control signals from control system 20 and is operable to block fuel flow to high-pressure fuel pump 38. Inlet metering valve 44 may be a proportional valve or may be an on-off valve that is capable of being rapidly modulated between an open and a closed position to adjust the amount of fuel flowing through the valve.

Fuel pressure sensor 54 is connected with fuel accumulator 40 and is capable of detecting or measuring the fuel pressure in fuel accumulator 40. Fuel pressure sensor 54 transmits or sends signals indicative of the fuel pressure in fuel accumulator 40 to control system 20. Fuel accumulator 40 is connected to each fuel injector 30. Control system 20 provides control signals to fuel injectors 30 that determines operating parameters for each fuel injector 30, such as the length of time fuel injectors 30 operate and the number of fueling pulses per a firing or injection event period, which determines the amount of fuel delivered by each fuel injector 30.

Figure 4:
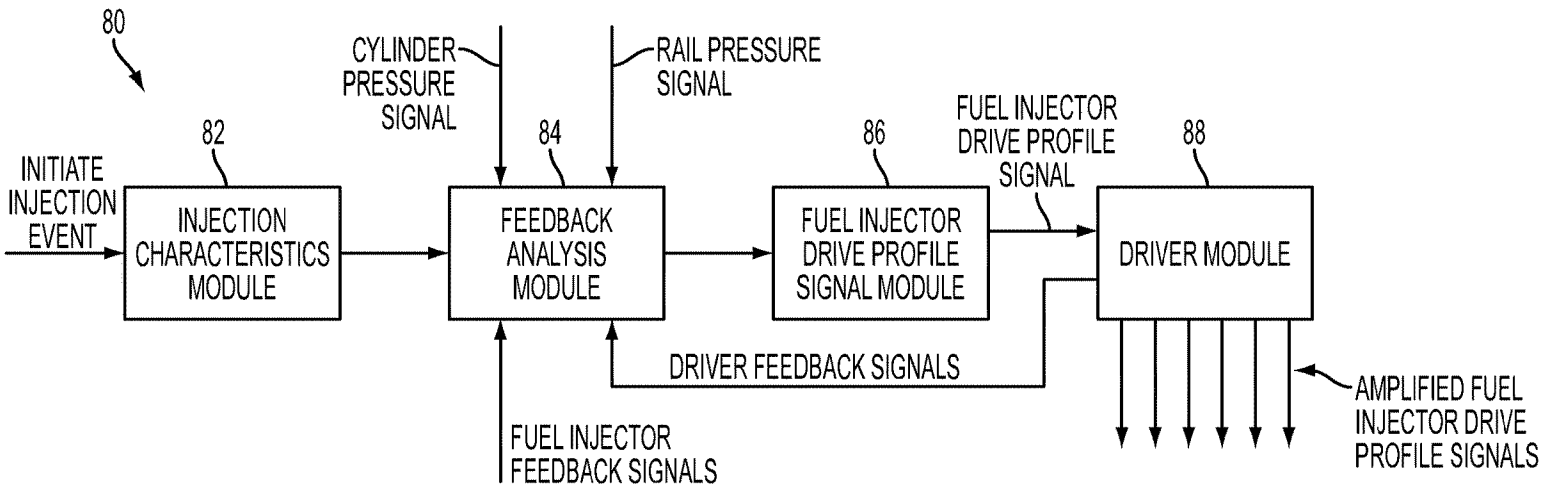
FIG. 4 is a fuel injector drive module of the engine of FIG. 1 in accordance with an exemplary embodiment of the present disclosure.

Referring to FIG. 4, a fuel injector drive module is shown and generally indicated at 80. Fuel injector drive module 80 includes an injection characteristics module 82, a feedback analysis module 84, a drive profile signal module 86, and a driver module 88. Fuel injector drive module 80 may be distributed over one or more elements of control system 20, such as control module 50, ASIC/FPGA 64, fuel injector driver 66, and ADC 70. Injection characteristics module 82 receives an injection event initiation signal generated in control module 50. Injection characteristics module 82 determines from various conditions, such as an engine load, engine RPM, and ambient conditions, the injection characteristics most appropriate to the operating conditions of engine 10. Injection characteristics module 82 transmits the fuel injection characteristics, which are fuel injector drive requirements, to feedback analysis module 84.

Feedback analysis module 84 receives the fuel injection characteristics from injection characteristics module 82, and one or more feedback signals from sensors positioned in, on, or connected to driver module 88, fuel injectors 30, fuel accumulator or rail 40, and engine cylinder 28. As an injection event progresses, feedback analysis module 84 compares the feedback signals to the fuel injection characteristics provided by injection characteristics module 82. Feedback analysis module 84 determines, from the one or more feedback signals, the amount of fuel actually being injected and the actual fuel injection rate, and compares the amount of fuel being injected to the amount requested by control module 50 and the actual fuel injection rate to the fuel injection characteristics provided by injection characteristics module 82. If there is an error or deviation, feedback analysis module 84 modifies the fuel injection characteristics and provides the modified fuel injection characteristics to drive profile signal module 86.

Drive profile signal module 86 receives the fuel injection characteristics, either the original fuel injection characteristics provided by injection characteristics module 82 or the modified fuel injection characteristics provided by feedback analysis module 84, and translates the fuel injection characteristics into the fuel injector drive profile signal. The fuel injector drive profile signal includes the shape of the fuel injector drive profile signal, which includes the amplitudes of the fuel injector drive profile signal and transition rates between differing amplitudes, and the duration of the fuel injector drive profile signal, which is approximately equivalent to the fuel injection event. Drive profile signal module 86 transmits the fuel injector drive profile signal to driver module 88.

Driver module 88 amplifies the fuel injector drive profile signal to the amplitudes required by drive profile signal module 86. The amplified fuel injector drive profile signal is then transmitted to fuel injector(s) 30, which then becomes one or more fuel injection events. Driver module 88 may also provide one or more feedback signals to feedback analysis module 84, described hereinabove. Fuel injector(s) 30 may also provide one or more feedback signals to feedback analysis module 84. Each of the feedback signals is provided during the fuel injection event, and modifications to the fuel injection characteristics and the fuel injector drive profile signal are made during a fuel injection event rather than being analyzed and fed forward to a future fuel injection event.

Figure 5:
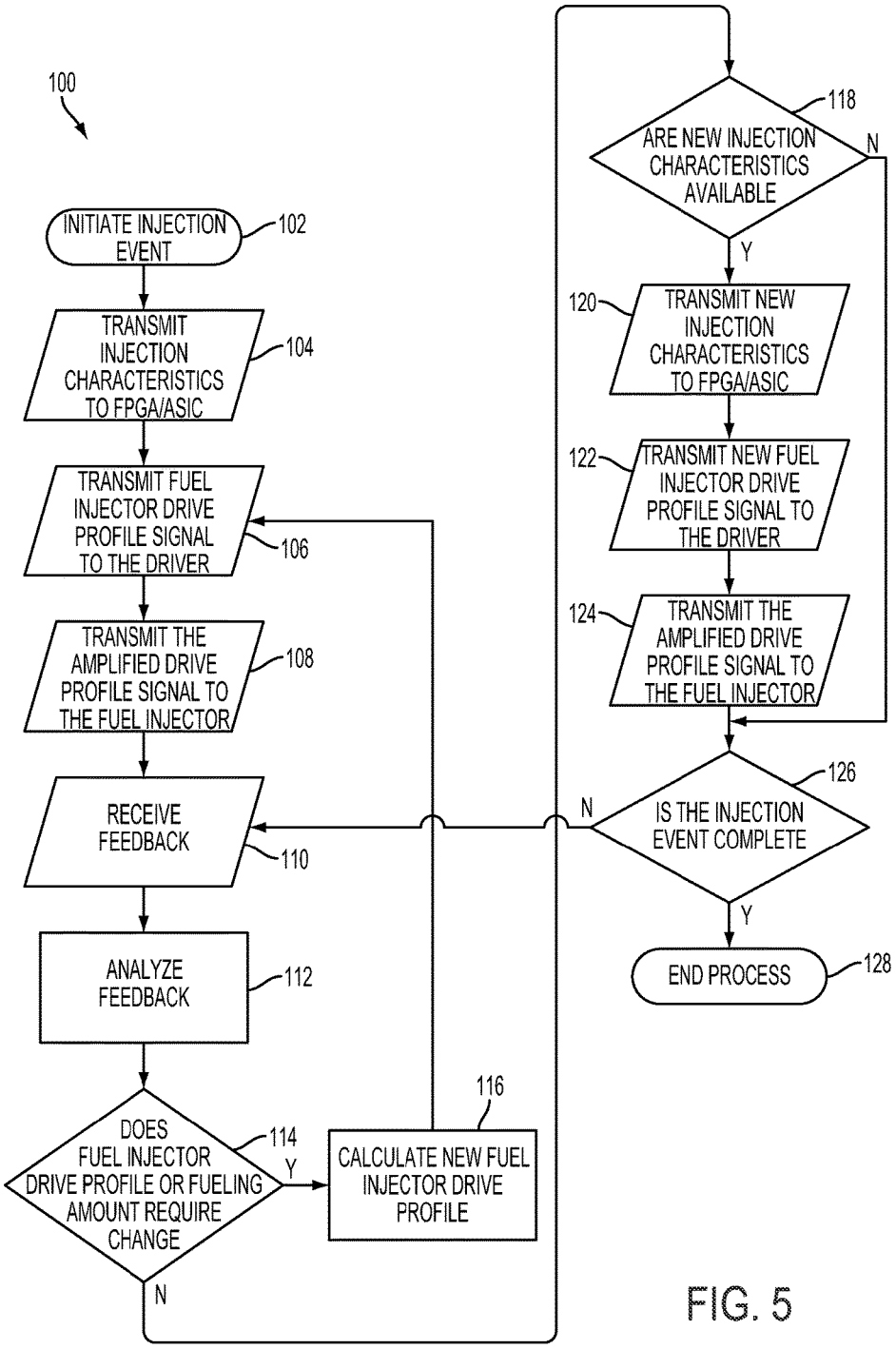
FIG. 5 is a process flow diagram for a fuel injector drive process of the fuel injector drive module of FIG. 4 in accordance with an exemplary embodiment of the present disclosure.

Referring to FIG. 5, a fuel injector control process is shown and generally indicated at 100. Fuel injector control process 100 may be distributed over one or more modules of fuel injector drive module 80. Fuel injector control process 100 begins with initiation of a fuel injection event by control module 50 at a process 102. Control module 50 determines the fuel injection characteristics required for fueling prior to initiation of the fuel injection event. For example, control module 50 determines the shape of the fuel injector drive profile signal, such as a trapezoidal shape, a square shape, a boot shape, etc., the required amplitude or amplitudes for the fuel injector drive profile signal, and the duration of the fuel injector drive profile signal, which corresponds to an on-time for fuel injector 30. A fuel injector drive characteristics signal is transmitted from control module 50 to ASIC/FPGA 64 at an injection characteristic transmission process 104.

Once ASIC/FPGA 64 receives the fuel injector drive characteristics signal, ASIC/FPGA 64 translates or converts the fuel injector drive characteristics signal into the fuel injector drive profile signal, which includes the actual voltage and current amplitude required to drive the fuel injector actuator (not shown) during the fuel injection event. The fuel injector drive profile signal is transmitted to fuel injector driver 66 in a drive profile signal process 106.

Fuel injector driver 66 receives the fuel injector drive profile signal from ASIC/FPGA 64 and amplifies the drive profile signal in response. The amplified drive profile signal is transmitted from fuel injector driver 66 to the corresponding fuel injector 30 in a fuel injector drive profile signal process 108. Fuel injector driver 66 also transmits one or more feedback signals to ADC 70, which may include piezoelectric, piezo, or magnetostrictive drive voltage signal 72 indicative of the drive voltage and piezoelectric, piezo, or magnetostrictive drive current signal 74.

Fuel injector 30 may also transmit feedback signals to ADC 70. For example, fuel injector 30 may transmit a feedback signal indicative of an internal fuel pressure in fuel injector 30, which may be described as fuel injector line pressure signal 76, and may transmit actuator feedback signal 78 indicative of the actual movement or actuation of the fuel injector actuator (not shown) of fuel injector 30. The feedback signals transmitted by fuel injector driver 66, fuel injector 30, and other feedback signals such as the cylinder pressure feedback signal and the rail pressure feedback signal are received by ADC 70 in a feedback process 110.

As described hereinabove, the feedback signals provided to ADC 70 are analog signals, which require conversion into a digital format prior to transmission of the feedback signals to ASIC/FPGA 64, and ADC 70 provides the conversion from analog to digital. After ASIC/FPGA 64 receives the feedback signals, ASIC/FPGA 64 analyzes the feedback signals in a feedback signal analysis process 112 to perform a comparison of the fuel injection rate as indicated by the feedback signals to the fuel injection rate expected based on the desired fuel injector drive profile signal originally generated in ASIC/FPGA 64 to determine whether there is a deviation from the desired fuel injector drive profile signal. ASIC/FPGA 64 also calculates the amount of fuel being delivered by the actual fuel injection rate and compares the calculated amount to the desired amount of fuel requested by control module 50 in feedback signal analysis process 112.

Once the analysis of the feedback signal(s) is complete, fuel injector control process 100 determines, based on the actual fuel injection rate shape, whether the fuel injection rate expected from the fuel injector drive profile signal is being achieved in fuel injector 30 and/or whether the estimated fueling is within a predetermined deviation from the amount of fueling requested by control module 50 in an accuracy decision process 114. If the actual shape of the fuel injection rate is deviating from the fuel injection rate shape expected from the fuel injector drive profile signal and/or the fueling amount is deviating from the fueling amount commanded by control module 50 by a predetermined amount, fuel injector control process 100 moves to a drive profile signal adjustment process 116, where the fuel injector drive profile signal is modified. Fuel injector control process 100 then moves to drive profile signal process 106 so that the modified fuel injector drive profile signal may be transmitted to driver 66, modifying the signal transmitted to fuel injector 30, and thus the fuel injector drive profile signal, during the fuel injection event.

Returning to accuracy decision process 114, if neither condition described hereinabove is met, fuel injector control process 100 moves to a new injection characteristics decision process 118. In new injection characteristics process 118, a determination of whether control module 50 is requesting new or modified fuel injection characteristics during the present injection event is made. If control module 50 is requesting new or modified fuel injection characteristics, control moves to a new injection characteristics transmission process 120, where FGPA/ASIC 64 receives the newly requested fuel injector drive characteristics signal from control module 50. Control then passes to a new drive profile signal process 122.

In new drive profile signal process 122, a new fuel injector drive profile signal is generated, which is then transmitted to fuel injector driver 66. Fuel injector drive profile signal process 122 functions similarly to fuel injector drive profile signal process 108 described hereinabove, using the new fuel injector drive profile signal. Driver 66 amplifies the new fuel injector drive profile signal and then transmits the amplified fuel injector drive profile signal to fuel injector 30 in modified drive signal process 124.

In an injection event decision process 126, a determination of whether the injection event is completed is made. If the injection event continues in process 100, control returns to feedback process 110, where fuel injector control process 100 continues as previously described. If the fuel injection event is finished, control is passed to a termination process 128, which completes fuel injector control process 100.

Referring again to the new injection characteristics process 118, if control module 50 is not requesting modified fuel injection characteristics, then control passes to injection event process 126, described hereinabove, and fuel injector control process 100 continues as described hereinabove.

Figure 6:
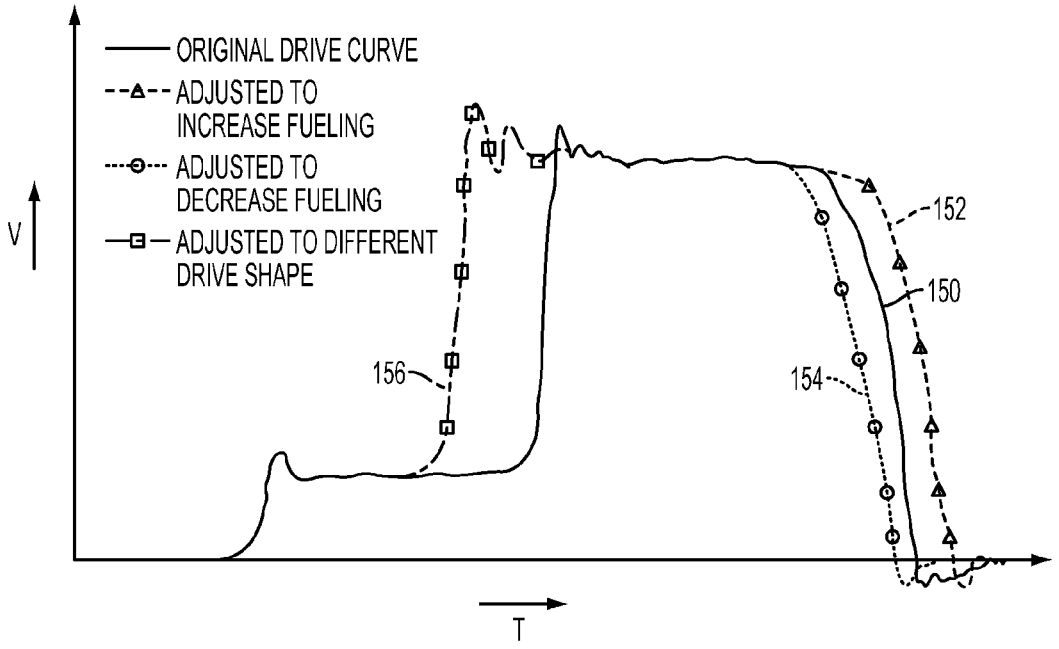
FIG. 6 depicts a plurality of representative fuel injector drive profile signals that may be generated by the interface module of FIG. 2 to change the timing of events during a fuel injection event in accordance with exemplary embodiments of the present disclosure.

The effect of the system of the present disclosure may be seen in FIG. 6, which shows exemplary fuel injector drive profile signals of the present disclosure. The original fuel injector drive profile signal requested in FIG. 6 is indicated at 150, which is a boot-shaped profile. During fuel injector control process 100, if process 100 determines that desired fueling is below the desired level of fueling, process 100 may increase the fuel injector on-time, thus forming curve 152. If process 100 determines that desired fueling is more than the desired level of fueling, process 100 may decrease the fuel injector on-time, thus forming curve 154. Fuel injector control process 100 may also receive a request from control module 50 to modify the fuel injection profile. For example, control module 50 may request a change from a boot shape to a square profile, a trapezoidal profile, or another profile. In the example of FIG. 6, curve 156 indicates that control module 50 requested a change from a boot shape profile to a square profile during the injection event. In each case, the fuel injection drive profile signal was modified as the injection event proceeded, providing significantly improved response and accuracy for each individual injection event.

It should be noted the examples of FIG. 6 are exemplary, and that the system of the present disclosure provides the ability to modify fuel injector drive profile signal overall curve shape, localized curve amplitude, curve length or duration, transition duration or slope, etc., thus providing significant near real time rate-shaping capability for an injection event. In addition to adjusting for errors and variation, the disclosed system also includes the capability of reducing fueling variation between cylinders and shot-to-shot for the same cylinder, depending on the criteria used for analysis of the feedback signals. Furthermore, it should also be apparent that the described system permits the ability to diagnose the health of fuel injector 30. For example, if fuel injector control process is unable to adjust the fuel injector drive profile signal to meet the characteristics requested by control module 50, then the problem is most likely a failure of fuel injector 30, though other issues may cause such a failure. Thus, the closed loop feedback of the present system may be used in conjunction with an On-Board Diagnostic (OBD) system to diagnose potentially catastrophic conditions of engine 10.

Figure 7:
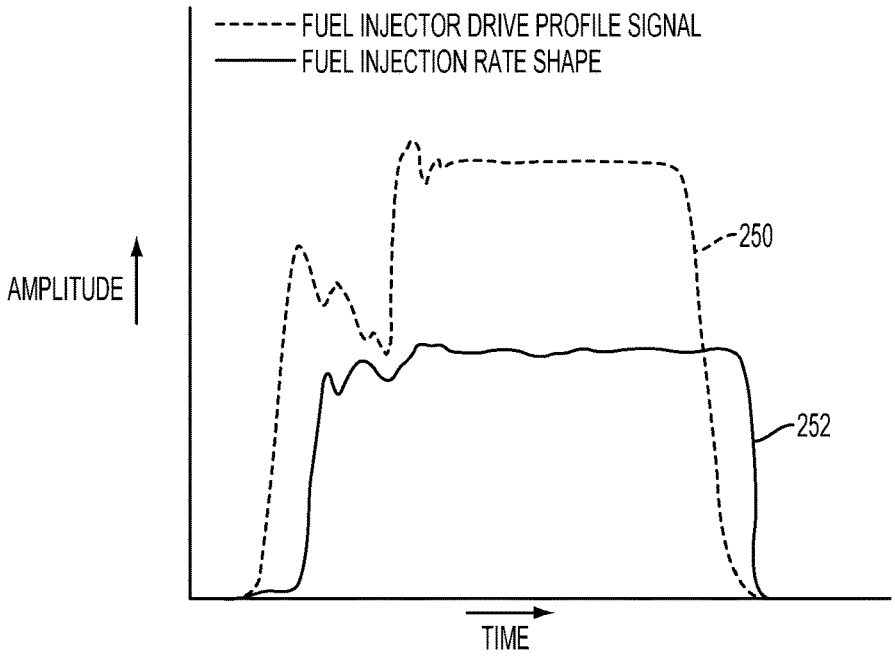
FIG. 7 depicts a first representative fuel injector drive profile signal that may be generated by the interface module of FIG. 2 in accordance with an exemplary embodiment of the present disclosure and a first fuel flow rate that corresponds with the first fuel injector drive profile signal.

FIG. 6 depicts changes to a fuel injector drive profile signal from one type of signal to another type of signal, as well as changes to an on-time. The system of the present disclosure can provide a nearly infinite number of fuel injector drive profile signals in addition to assuring the accuracy of those fuel injector drive profile signals. FIG. 7 depicts a first representative fuel injector drive profile signal 250 that may be generated by ASIC/FPGA 64 of interface module 60, and a first fuel flow rate or first fuel injection rate shape 252, which is the actual fuel flow into combustion chamber 32 and which corresponds with fuel injector drive profile signal 250. First fuel injection rate shape 252 is a square fueling shape, which is accurately generated because of the precise control of fuel injector drive profile signal 250.

Figure 8:
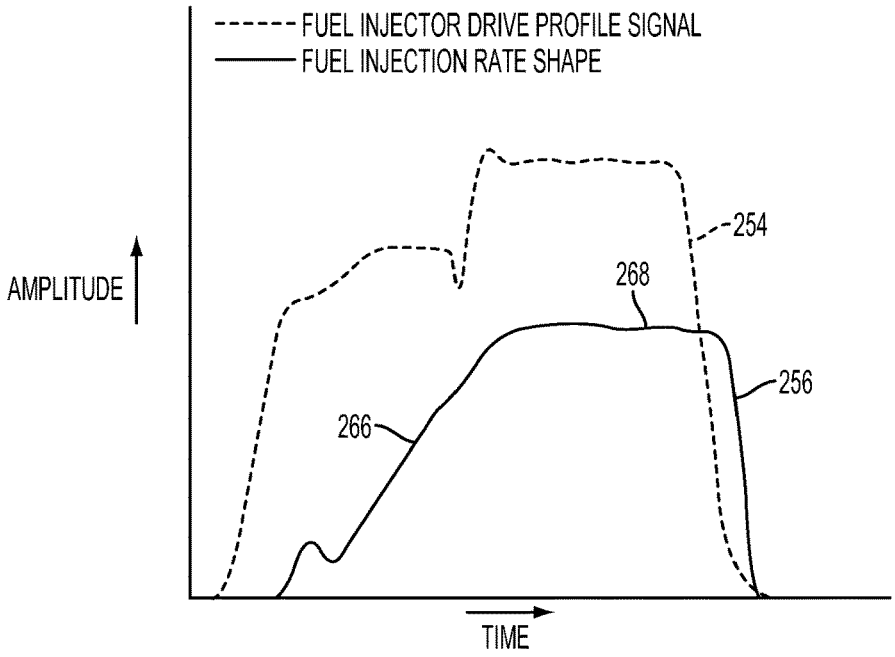
FIG. 8 depicts a second representative fuel injector drive profile signal that may be generated by the interface module of FIG. 2 in accordance with an exemplary embodiment of the present disclosure and a second fuel flow rate that corresponds with the second fuel injector drive profile signal.

FIG. 8 depicts a second representative fuel injector drive profile signal 254 that may be generated by ASIC/FPGA 64 of interface module 60, and a second fuel flow rate or second fuel injection rate shape 256, which is the actual fuel flow into combustion chamber 32 and which corresponds with fuel injector drive profile signal 254. Second fuel injection rate shape 256 includes a ramp portion 266 leading into a square portion 268. The ability to generate the precision of ramp portion 266 is because of the precise control of fuel injector drive profile signal 254.

Figure 9:
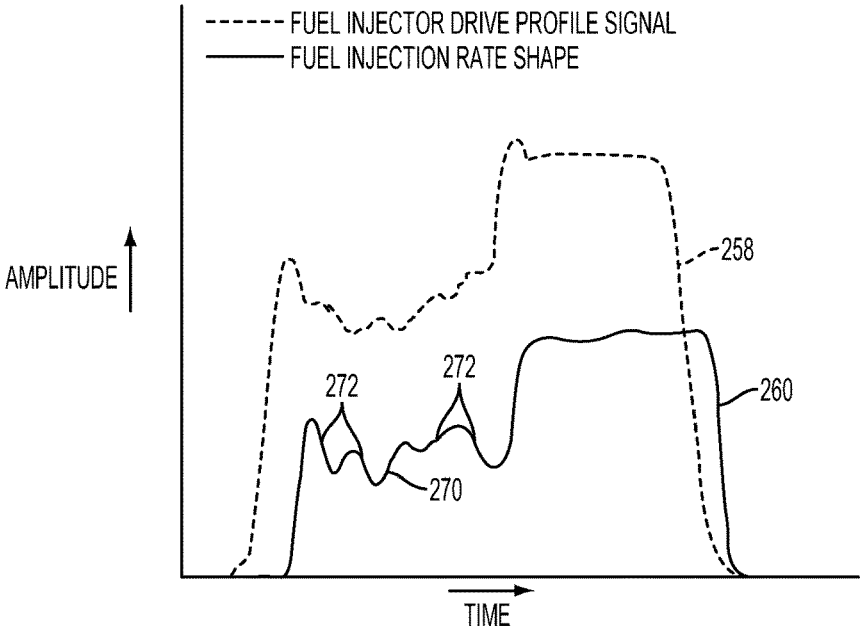
FIG. 9 depicts a third representative fuel injector drive profile signal that may be generated by the interface module of FIG. 2 in accordance with an exemplary embodiment of the present disclosure and a third fuel flow rate that corresponds with the third fuel injector drive profile signal.

FIG. 9 depicts a third second representative fuel injector drive profile signal 258 that may be generated by ASIC/FPGA 64 of interface module 60, and a third fuel flow rate or third fuel injection rate shape 260, which is the actual fuel flow into combustion chamber 32 and which corresponds with fuel injector drive profile signal 258. Third fuel injection rate shape 260 includes a first boot portion 270 having a plurality of rate increases and decreases 272. The ability to provide accurate rate increases and decreases 272 provides the ability to precisely control the flow of fuel from fuel injector 30 into combustion chamber 32, providing for optimal mixing of fuel and air in combustion chamber, decreasing emissions and increasing combustion efficiency.

Figure 10:
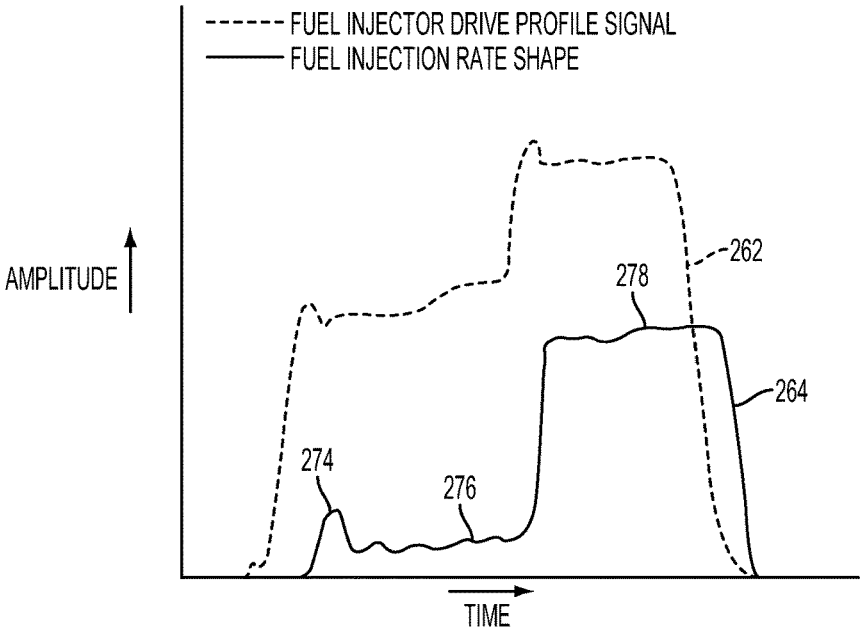
FIG. 10 depicts a fourth representative fuel injector drive profile signal that may be generated by the interface module of FIG. 2 in accordance with an exemplary embodiment of the present disclosure and a fourth fuel flow rate that corresponds with the fourth fuel injector drive profile signal.

FIG. 10 depicts a fourth second representative fuel injector drive profile signal 262 that may be generated by ASIC/FPGA 64 of interface module 60, and a fourth fuel flow rate or fourth fuel injection rate shape 264, which is the actual fuel flow into combustion chamber 32 and which corresponds with fuel injector drive profile signal 262. Fourth fuel injection rate shape 264 includes an initial first rate of fuel flow 274, which then decreases to a first boot portion 276 prior to an increase to a second boot portion 278. The initial burst of fuel provided during initial first rate of fuel flow 274 permits shaping a fuel charge in combustion chamber 32 because of the capability of ASIC/FPGA 64.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

What is claimed is:

1. A system, comprising:

an engine having a fuel injector;

a fuel controller configured to generate control signals corresponding to a desired fueling profile of a fuel injection event; and a fueling profile interface that outputs drive profile signals to the fuel injector in response to the control signals to cause the fuel injector to deliver an actual fueling profile, wherein the fueling profile interface changes the drive profile signals during the fuel injection event in response to the actual fueling profile delivered by the fuel injector.

2. The system of claim 1, wherein the parameter signal corresponds to at least one of an analog fuel injector line pressure and an analog fuel injector actuator position.

3. The system of claim 1, wherein the parameter signal is proportional to the movement of at least one of a fuel injector actuator, a fuel injector needle, a fuel injector nozzle valve element, and a fuel injector component configured to operate in response to the drive profile signals outputted by the fueling profile interface.

4. The system of claim 1, wherein the characteristic indicated by the parameter signal is at least one of a cylinder pressure, a fuel accumulator pressure, an engine crank angle, and a fuel pressure in an engine fuel system.

5. The system of claim 1, wherein at least one of the fuel controller and an analog-to-digital converter is configured to generate a plurality of digital input signals; and the fueling profile interface configured to generate a first set of output signals in response to the plurality of digital input signals generated from at least one of the fuel controller and the analog to digital converter.

6. The system of claim 5, wherein the analog to digital converter is configured to receive a plurality of signals corresponding to characteristics of the actual fueling profile.

7. The system of claim 5, wherein the fueling profile interface is configured to amplify the first set of output signals and generate the drive profile signals to cause a change in the actual fueling profile.

8. The system of claim 7, wherein the fueling profile interface is configured to generate one or more feedback signals corresponding to at least one of a fuel injector drive voltage and a fuel injector drive current.

9. A control system, comprising:

a fuel controller configured to generate control signals corresponding to a desired fueling profile of a fuel injection event; and a fueling profile interface including at least one analog to digital converter, wherein the fueling profile interface is configured to receive the control signals from the fuel controller and feedback signals from the at least one analog to digital converter and provide drive profile signals, and the fueling profile interface is configured to receive at least one of a fuel injection rate and a fuel injection amount;

the fueling profile interface including instructions configured to modify the drive profile signals during a fuel injection event in response to at least one of the fuel injection rate deviating from a predetermined threshold fuel injection rate and the fuel injection amount deviating from a predetermined threshold fuel injection amount.

10. The control system of claim 9, wherein the desired fueling profile includes a predetermined threshold amount of fuel to be injected by a fuel injector and the drive profile signals provided by the fueling profile interface include a predetermined threshold fuel injection rate.

11. The control system of claim 9, wherein modifying the drive profile signals includes reducing an error between the fuel injection rate and the predetermined threshold fuel injection rate and reducing an error between the fuel injection amount and the predetermined threshold fuel injection amount.

12. The control system of claim 9, wherein the feedback signals correspond to an internal parameter of a fuel injector and include at least one of a fuel injector line pressure and a fuel injector actuator position.

13. The control system of claim 9, wherein the feedback signal corresponds to at least one of an engine cylinder pressure, a fuel accumulator pressure, an engine crank angle, a fuel pressure in an engine fuel system, a fuel injector drive voltage and a fuel injector drive current.

14. The control system of claim 9, wherein the fueling profile interface provides a first set of modified drive profile signals to a fuel injector and device provides a second set of modified drive profile signals to the fuel injector, wherein the amplitude of the second set of modified drive profile signals is greater than the amplitude of the first set of modified drive profile signals.

15. An apparatus, comprising:

a first input component configured to receive a plurality of control signals from a fuel controller, the plurality of control signals corresponding to one or more expected characteristics of a fuel injection event;

a second input component configured to receive one or more feedback signals corresponding to one or more actual characteristics of the fuel injection event; and a plurality of logic cells configured to provide a modified fuel injector drive signal during the fuel injection event based on the plurality of control signals and the one or more feedback signals.

16. The apparatus of claim 15, wherein the one or more feedback signals correspond to at least one of an engine fuel rail pressure, a fuel injector actuator voltage, a fuel injector actuator current, an engine cylinder pressure, and a fuel injector line pressure.

17. The apparatus of claim 16, wherein the plurality of control signals provided by the fuel controller correspond to at least one of an expected fuel injector line pressure, an expected engine cylinder pressure, an expected fuel injector actuator voltage, an expected fuel injector actuator current, an expected engine fuel rail pressure, and a fuel injector correction trim.

18. The apparatus of claim 17, wherein the plurality of logic cells are configured to include signal summing instructions that receive the one or more feedback signals and the plurality of control signals, and to provide at least one of a fuel injector line pressure deviation signal, an engine cylinder pressure deviation signal, a fuel injector actuator voltage deviation signal, and a fuel injector actuator current deviation signal.

19. The apparatus of claim 18, wherein the plurality of logic cells are configured to include instructions for an engine fuel rail pressure adjustment that provides an engine fuel rail pressure scaling factor signal based on the expected engine fuel rail pressure signal and the engine fuel rail pressure feedback signal.

20. The apparatus of claim 19, wherein the plurality of logic cells are configured to include instructions for a fuel injector line pressure adjustment that provides a fuel injector line pressure control signal based on the fuel injector line pressure deviation signal, instructions for an engine cylinder pressure adjustment that provides an engine cylinder pressure control signal based on the engine cylinder pressure deviation signal, and instructions for a fuel injector actuator voltage or current adjustment that provides at least one of a fuel injector actuator voltage control signal based on the fuel injector actuator voltage deviation signal and a fuel injector actuator current control signal based on the fuel injector actuator current deviation signal.

21. The apparatus of claim 20, wherein the signal summing instructions are configured to modify the fuel injector drive signal by at least of the fuel rail pressure scaling factor signal, the fuel injector line pressure control signal, the engine cylinder pressure control signal, the fuel injector actuator voltage control signal, and the fuel injector actuator current control signal.

22. A method, comprising:

providing a drive profile signal to a fuel injector to cause a fuel injection event;

receiving a feedback signal indicating a parameter value of the fuel injection event;

determining a deviation value by comparing the parameter value to an expected value of the fuel injection event; and modifying the drive profile signal during the fuel injection event in response to the deviation value exceeding a predetermined threshold deviation value.

23. The method of claim 22, wherein the feedback signal indicating a parameter value corresponds to at least one of a fuel injector line pressure, a fuel injector actuator position, an engine cylinder pressure, an engine fuel rail pressure, an engine crank angle, a fuel accumulator pressure, a fuel injector actuator voltage, and a fuel injector actuator current.

24. The method of claim 23, wherein the expected value includes at least one of an expected fuel injector line pressure, an expected fuel injector actuator position, an expected engine cylinder pressure, an expected engine fuel rail pressure, an expected engine crank angle, an expected fuel accumulator pressure, an expected fuel injector actuator voltage, and an expected fuel injector actuator current.

25. The method of claim 22, wherein the drive profile signal includes a parameter value corresponding to an expected threshold fuel injection rate and an expected threshold fuel injection amount.

26. The method of claim 22, wherein modifying the fuel injector drive signal includes reducing an error between a fuel injection rate and the expected threshold fuel injection rate and reducing an error between a fuel injection amount and the expected threshold fuel injection amount.

* * * * *